United States Patent [19]

Balachandran

[11] 4,345,567

[45] Aug. 24, 1982

[54] FUEL SUPPLY SYSTEM

[75] Inventor: Chandrasegaram Balachandran, London, England

[73] Assignee: Lucas Industries Limited, Birmingham, England

[21] Appl. No.: 141,157

[22] Filed: Apr. 17, 1980

[30] Foreign Application Priority Data

May 12, 1979 [GB] United Kingdom ..... 7916558

[51] Int. Cl.[3] ..... F02B 77/00; F02B 33/00

[52] U.S. Cl. ..... 123/510; 123/557

[58] Field of Search ..... 123/510, DIG. 2, 514, 123/179 G, 516, 445, 446, 557; 210/416.4

[56] References Cited

U.S. PATENT DOCUMENTS

| | | | |
|---|---|---|---|
| 3,316,891 | 5/1967 | McKay | 123/510 |
| 3,548,796 | 12/1970 | Gastinne | 123/510 |
| 4,036,182 | 7/1977 | Gandy | 123/557 |
| 4,039,637 | 8/1977 | Grosseau | 123/510 |
| 4,187,813 | 2/1980 | Stumpp | 123/557 |
| 4,223,652 | 9/1980 | Budnicki | 123/557 |

FOREIGN PATENT DOCUMENTS

| | | | |
|---|---|---|---|
| 2460101 | 6/1976 | Fed. Rep. of Germany | 123/514 |
| 1395969 | 5/1975 | United Kingdom | 123/515 |

*Primary Examiner*—Raymond A. Nelli

[57] ABSTRACT

A fuel system for a diesel engine includes a low pressure pump for supplying fuel to a high pressure pump, the low pressure pump drawing fuel from the outlet of a filter unit having an inlet connected in use to a fuel tank. A reservoir is provided having an outlet connected by restricted passage means to the outlet of the filter unit and an inlet through which fuel can flow to the reservoir and a further outlet through which surplus fuel can flow from the reservoir. Fuel being drawn from the reservoir in the event that the fuel tank is emptied to allow a restricted flow of fuel to the engine, the fuel in the reservoir allowing the engine to be operated at low speed to assist fuel flow from the tank when the latter is re-filled.

4 Claims, 3 Drawing Figures

FIG. 1.
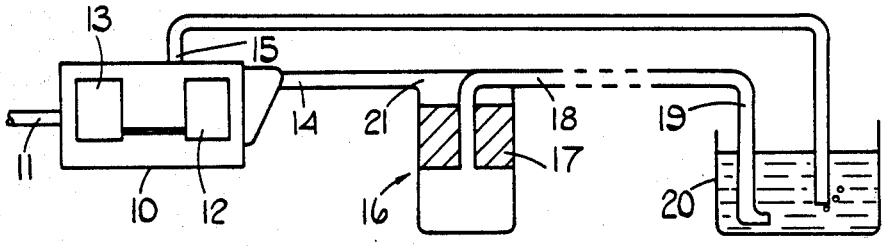
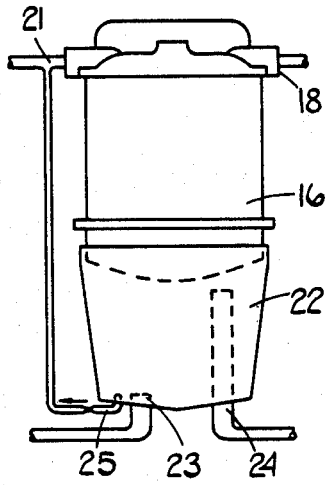
FIG. 2.
FIG. 3.
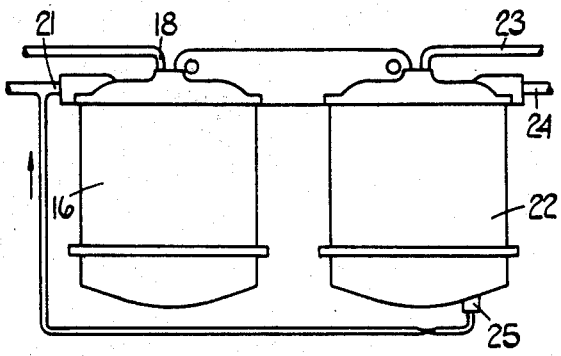

FUEL SUPPLY SYSTEM

This invention relates to a fuel supply system for a diesel engine and of the kind comprising a fuel pumping apparatus which includes a high pressure pump which in use supplies fuel at high pressure to the injection nozzles of the engine, and a low pressure feed pump which draws fuel through a fuel inlet of the apparatus and supplies fuel to the high pressure pump, the apparatus also having a drain outlet through which fuel and air collecting within a cavity of the apparatus can escape, the system further including a filter connected to the fuel inlet and through which fuel is drawn by said feed pump from a supply tank.

With such a system a problem arises when the level of fuel in the supply tank is allowed to fall to the extent that air is drawn into the filter and into the fuel inlet of the apparatus. The air will be separated from the fuel within the apparatus and the high pressure pump will continue to supply fuel at a reduced rate so that the engine will be starved of fuel. The fact that the engine operates at reduced power will be a warning to the operator that something is amiss and that he should stop the engine to investigate the trouble. If he continues to use the engine the fuel will eventually be exhausted. If after he has stopped the engine or it has stopped of its own accord due to fuel starvation, and the fuel tank is replenished then the system must be purged of air. If a hand priming pump is incorporated in the system then this task is facilitated. However, if no such pump is fitted then the engine must be cranked to draw fuel from the tank through the filter to the feed pump.

Cranking the engine will place a considerable load on the starter motor of the engine and also the storage battery. The process of priming will however be facilitated if the engine can be operated at reduced speed.

The object of the invention is to provide a fuel supply system of the kind specified in a simple and convenient form.

According to the invention a fuel supply system of the kind specified comprises a reservoir, passage means for maintaining the reservoir full of fuel during operation of the engine and restricted passage means extending from said reservoir and through which fuel can be drawn from said reservoir at a restricted rate.

Examples of fuel supply systems in accordance with the invention will now be described with reference to the accompanying drawings in which:

FIG. 1 is a diagrammatic illustration of a known form of fuel system,

FIG. 2 is a diagrammatic side elevation of a modification of part of the apparatus, and FIG. 3 shows a further modification.

Referring to FIG. 1 of the drawings, the fuel supply system includes a fuel pumping apparatus generally indicated at 10, and which has an input shaft 11 which in use, is driven in timed relationship with the associated engine. The apparatus includes a low pressure feed pump 12 and a high pressure pump 13, the latter supplying fuel through a plurality of outlets (not shown), to injection nozzles respectively of the associated engine. The feed pump 12 draws fuel through a fuel inlet 14. In addition the apparatus is provided with a drain outlet 15 through which in use, fuel collecting in a cavity defined within the apparatus 10 can pass together with any air which is separated from the fuel within the apparatus. Normally the fuel flowing through the outlet 15 will be as a result of leakage in the high pressure pump, but it can be arranged that there is a deliberate leakage of fuel into the cavity to facilitate separation of the air and fuel.

The fuel inlet 14 is connected to the outlet 21 of a fuel filter 16. The filter 16 houses a filter element 17 which is of annular form and the inlet 18 of the fuel filter is connected to a feed pipe 19 associated with a fuel supply tank 20. The filter element 17 is of annular form and fuel from the inlet 18 passes down through the centre of the filter from whence it flows through the filter element to the outlet 21.

In the event that the level of fuel in the supply tank falls to such an extent that air is drawn in through the inlet 18 of the filter, the level of fuel in the filter unit will gradually fall until it is just below the level of the element 17. When this occurs no further fuel flows through the outlet 21 and a reduced rate of flow of fuel to the high pressure pump 13 will occur. As a result the engine will be starved of fuel and its output will be reduced. The operator will notice the reduced output of the engine and should stop the engine to investigate. If however he continues to run the engine then when no more fuel is supplied to the high pressure pump, no more fuel will be supplied to the engine and the latter will stop. The operator must then replenish the fuel tank 20.

Once the tank is replenished the engine can be cranked to draw fuel through the filter, the air which will be drawn by the low pressure pump 12 will pass through the outlet and eventually sufficient fuel will be available for supply the high pressure pump 13 to effect operation of the engine. Such cranking of the engine will impose a strain on the starter motor and the storage battery. The strain will be minimised if the engine can be started quickly and allowed to run at a reduced speed. This can be achieved by providing a reservoir of fuel.

In FIG. 2 the filter is indicated at 16 with the inlet 18 connected to the supply tank and the outlet 21 which is connected to the inlet 14 of the pumping apparatus. Associated with the filter is a reservoir 22 which conveniently comprises a cup-shaped member secured to the housing of the filter. The reservoir has an inlet 23 which is connected to the drain outlet 15 of the apparatus, the inlet opening into the reservoir near the lower end thereof. The reservoir is also provided with an outlet 24 which is connected to the supply tank and the outlet 24 leads from the upper portion of the reservoir. A further outlet 25 is provided and this is connected to the outlet 21. The outlet 25 embodies a restrictor so that during normal use there will be a limited flow of fuel through the outlet 25. The fuel which is returned from the pumping apparatus flows through the inlet 23 and the level of the fuel in the reservoir 22 is maintained to the height of the outlet 24. When the fuel tank in use has been allowed to run dry and is replenished a restricted flow of fuel can occur through the outlet 25 for the purpose of facilitating the priming of the system by allowing the engine to operate at a low speed for example at or slightly above idling speed.

A similar arrangement is shown in FIG. 3 but in this case the reservoir 22 is constituted by a separate chamber disposed alongside the filter 16.

When the system has just been assembled the reservoir 22 can be filled with fuel to enable more rapid starting of the engine to be obtained. In the case of the example shown in FIG. 3, the filter element 17 may be changed in service and rapid priming of the system obtained. In the case of the example shown in FIG. 2 this is more difficult because of the nature of the construction.

The systems as described with reference to FIGS. 2 and 3 have the further advantage that some of the filtered fuel flowing through the drain outlet 15 is returned to the inlet 14 of the pumping apparatus instead of being returned to the tank and being drawn through the filter again when it is supplied to the engine. As a result the life of the filter element is extended because even though the fuel is clean when it is returned to the tank it will pick up foreign material in the tank.

I claim:

1. A fuel supply system for a diesel engine comprising a fuel pumping apparatus which includes a high pressure pump which in use supplies fuel at high pressure to the injection nozzles of the engine, and a low pressure feed pump which draws fuel through a fuel inlet of the apparatus and supplies fuel to the high pressure pump, the apparatus also having a drain outlet through which fuel and air collecting within a cavity of the apparatus can escape, the system further including a filter and inlet means connecting the filter to the fuel inlet and through which fuel is drawn by said feed pump from a supply tank to said pumping apparatus via the filter, a reservoir attached to the filter and fluidly interposed between said supply tank and said pumping apparatus, fluid passage means connecting said reservoir to said fuel pumping apparatus for conducting fuel from said pumping apparatus to said reservoir for maintaining the reservoir full of fuel during operation of the engine, outlet passage means fluidly connecting said reservoir to said supply tank, said outlet passage being located in said reservoir to define a predetermined level of fluid in said reservoir, and restricted passage means fluidly connecting said reservoir and said inlet means to by-pass the filter and fluidly connect the pumping apparatus and said reservoir so that fuel will be supplied to said pumping apparatus at a restricted rate from said reservoir via said restricted passage means if fuel in said supply tank is exhausted.

2. A fuel supply system according to claim 1 in which said passage means is connected to said drain outlet.

3. A fuel supply system according to claim 1 in which said restricted passage means communicates with a lower part of said reservoir, and said reservoir outlet passage means extends from an upper part of the reservoir.

4. A fuel system according to claim 3 in which said reservoir is separate from said filter.

* * * * *